US008752560B2

(12) United States Patent
Salicunaj

(10) Patent No.: US 8,752,560 B2
(45) Date of Patent: Jun. 17, 2014

(54) EYELASH SPOON

(76) Inventor: Violeta Salicunaj, Reinach AG (CH)

( * ) Notice: Subject to any disclaimer, the term of this patent is extended or adjusted under 35 U.S.C. 154(b) by 513 days.

(21) Appl. No.: 12/303,273

(22) PCT Filed: Mar. 23, 2007

(86) PCT No.: PCT/CH2007/000158

§ 371 (c)(1),
(2), (4) Date: Dec. 3, 2008

(87) PCT Pub. No.: WO2007/143864

PCT Pub. Date: Dec. 21, 2007

(65) Prior Publication Data

US 2009/0183747 A1 Jul. 23, 2009

(30) Foreign Application Priority Data

Jun. 14, 2006 (CH) ..... 969/06
Sep. 22, 2006 (CH) ..... 1520/06

(51) Int. Cl.
*A45D 40/30* (2006.01)
*A45D 7/00* (2006.01)

(52) U.S. Cl.
USPC ..... 132/200; 132/216; 132/217

(58) Field of Classification Search
USPC ..... 132/200, 216, 217, 214, 319
See application file for complete search history.

(56) References Cited

U.S. PATENT DOCUMENTS

| | | | | |
|---|---|---|---|---|
| 1,873,928 | A * | 8/1932 | Bohner | 132/216 |
| 1,907,476 | A | 5/1933 | Ballard et al. | |
| 2,260,614 | A | 10/1941 | Freitas | |
| 4,807,650 | A * | 2/1989 | Bliss | 132/319 |
| 5,178,170 | A | 1/1993 | Kassai | |
| 5,957,142 | A | 9/1999 | Karafilis | |

FOREIGN PATENT DOCUMENTS

EP 0902629 1/2001

* cited by examiner

*Primary Examiner* — Rachel Steitz
(74) *Attorney, Agent, or Firm* — Volpe and Koenig, P.C.

(57) ABSTRACT

An eyelash spoon (1) and a method for applying mascara to the eyelashes (19) on an eyelid (9) permit an easy and effective application of mascara to the eyelashes (19). The eyelash spoon (1) includes a dish-type body (3) with cut-out sections (11*a*, 11*b*) matching the shape of the eye. The convex exterior of the dish-type body (3) serves as a bearing surface for the eyelash brush. A handle for holding the eyelash spoon (1) can be attached permanently or in a detachable manner to the shell (3).

11 Claims, 3 Drawing Sheets

EYELASH SPOON

BACKGROUND

The invention relates to an eyelash spoon and a method for applying mascara to eyelashes.

In order to apply mascara to the eyelashes at an eyelid conventionally, the eyelash brush, which is soaked in mascara, is guided and/or rolled over the eyelashes from the bottom, beginning at the root of the eyelashes and/or the lash-line, towards the tips of the eyelashes, with the eye being open. Here, the eyelid can be pulled up and/or stretched with one or more fingers of one hand, if necessary. The mascara applied to the eyelashes causes the eyelashes to look stronger and longer. Sometimes mascara also includes rayon or nylon fibers, which in addition to emphasizing color also result in an actual extension of the eyelashes.

Further, it is known to deform eyelashes via eyelash curlers such that their natural curve is enhanced. Such a device is known from EP-B1-0902629, for example. Eyelash curlers are disadvantageous in that they can damage or pull out eyelashes. Therefore the object of the present invention is to provide a device and a method for a simple, careful, and effective application of mascara onto eyelashes.

SUMMARY

This is attained in an eyelash spoon and a method to apply mascara according to the invention.

With the method according to the invention and the eyelash spoon according to the invention pressure can be applied to the eyelashes from the bottom when mascara is applied with the brush. Here, the exterior surface of the appropriately curved eyelash spoon serves as a contact surface for the eyelashes. This way the convex curvature of the eyelashes can be directly enhanced when mascara is applied. The mascara spoon comprises two concave recesses, positioned diametrically opposite each other, which are adjusted to the shape of the eye. The width of the eyelash spoon is smaller at the side of the recesses opposite the handle than at the side facing the handle. By this ergonomic shape the eyelash spoon can contact the eyelid even close to the nose without any obstruction. The larger width of the eyelash spoon in the area of the recesses at the side of the handle takes into account that the length of eyelashes is generally greater at the outside of the eye than the inside. One strip is embodied along each recess at the interior side of the spoon as an adhering profile and/or adhering element. The adhering element can be formed as a roughened surface, e.g., in an eyelash spoon made from stainless steel. Using the eyelash spoon the lid can be evenly pulled up along the lash-line. This way, the mascara can be applied in a simple way from the lash-line to the tips of the eyelashes. In this manner an optic compacting of the lash-line and an enhanced curve of the eyelashes can be achieved. The eyelashes are thus provided with more volume and with a swing effect or curling effect.

Using the eyelash spoon, the clogging of the eyelashes can be prevented because they are supported on the eyelash spoon and are brushed through when the mascara is applied. Additionally, the eyelash spoon protects the eyelids from any discoloration by the mascara.

BRIEF DESCRIPTION OF THE DRAWINGS

In the following, the invention is explained in greater detail using the figures. Shown here are.

DETAILED DESCRIPTION OF THE PREFERRED EMBODIMENTS

Figure 1:
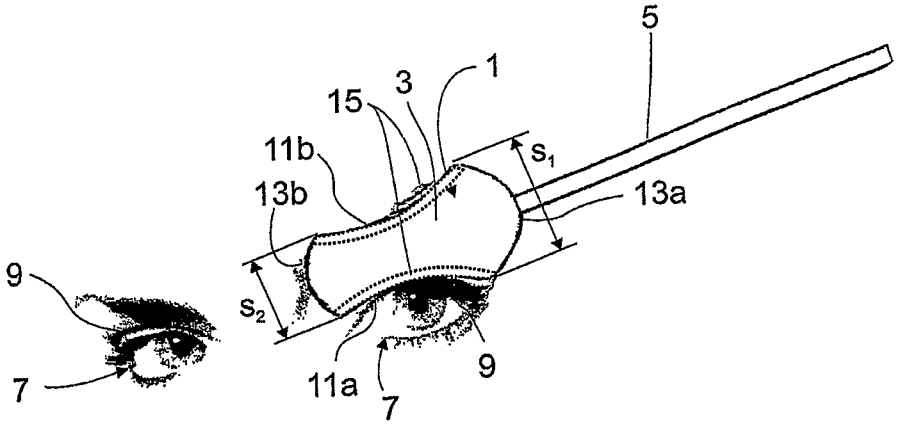
FIG. 1 is a view showing the application of the eyelash spoon in a first embodiment.

FIG. 1 shows the application of an eyelash spoon 1 in a first embodiment. The eyelash spoon 1 comprises a shell 3 and a handle 5. In the embodiment according to FIG. 1, the shell 3 has essentially the shape of a spherical calotte with two diametrically opposite recesses 11*a*, 11*b*, concavely rounded in reference to the shell 3, (thus) adjusted to the shape of an eye 7 and/or an eyelid 9. The shell 3 of such an eyelash spoon 1 is defined with the help of a first sphere having a first spherical radius and two additional spheres having a second and a third spherical radius, with the second and the third sphere intersecting the first sphere. A section of the first spherical surface forms the calotte, which forms the basic shape of the shell 3. From this calotte the two other spheres cut out the respective recesses 11*a* and 11*b*. The rims and/or edges and corners of the shell 3 are rounded such that they represent no risk for injuring the eye 7.

The handle 5 is embodied in form of a rod, staff, or tube and connected in a fixed manner to the shell 3, e.g., at one of the convexly curved lateral edges 13*a*, 13*b* positioned opposite each other. It may have, e.g., a round or an angular profile or any other shape suitable for the shell 3 to be manually held and/or guided. The handle 5 can be connected to the shell 3, e.g., in one piece or be connected to the shell 3 as a detachable part, e.g., via a snapping or screw connection. In particular, the handle 5 can also comprise several parts that can be assembled or screwed together, or connected to each other in any other way. The handle 5 may be provided with a smooth or a structured surface. In particular, there is the option to apply cut or uncut gems at the handle. Alternatively, the handle 5 can also be embodied extending telescopically and/or at least partially displaceable over the convexly curved exterior of the shell 3. This is advantageous in that the length of the makeup spoon 1 can be largely reduced for storage and transportation (e.g., in a small etui.)

The shell 3 and/or the handle 5 may be produced e.g., from chromium steel, preferably stainless and acid-resistant as well as dishwasher-proof stainless steel with an approximately 18% chromium and 10% nickel portion or another metal or plastic, which can be tolerated by the skin and resistant to chemicals.

In a preferred embodiment of the eyelash spoon 1 the edge of the shell 3 comprises an adhering element 15 at least in the area of the recesses 11*a*, 11*b*. In an eyelash spoon 1 made from stainless steel with its surface including the faceted edges being buffed to high gloss, the adhering element 15 can be embodied e.g., as an approximately 2 mm to approximately 6 mm wide strip, bead-sanded, sandblasted, matt brushed, provided with an engraved graphic structure (e.g., having dimensions ranging from approximately 50 to approximately 100 micrometers), or otherwise roughened strip at the inside of the surface of the eyelash spoon along the recesses 11*a*, 11*b*. Alternatively the entire interior surface of the shell 3 can be roughened as well.

The adhering element 15 can alternatively be produced e.g., from rubber or a rubber-like material. The adhering element 15 can e.g., be adhered to the side of the shell 3 facing the eye during application of the eyelash spoon 1 or applied in an injection molding process. At least the hard shell 3 and the soft and/or elastic adhering element 15 can be produced in a two-component injection molding process in a single step. Alternatively, the adhering element 15 can also be formed U-shaped and be put over the edge of the shell 3. Alternatively the entire shell 3 may also be coated with an adhering layer or be formed from a material having good adhering properties on the skin. The adhering element 15 allows a problem-free pulling up and holding of the upper eyelid 9 even at very small pressures without smearing any already applied eye-shadow.

Figure 5B:
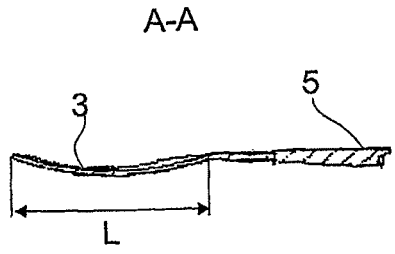
FIG. 5*b* is a longitudinal cross-sectional view of the eyelash spoon along a line marked "A" in FIG. 5*a*.
Figure 5C:
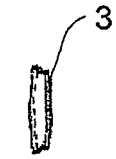
FIG. 5*c* is a cross-sectional view of the eyelash spoon along a line marked "B" in FIG. 5*a*.
Figure 5A:
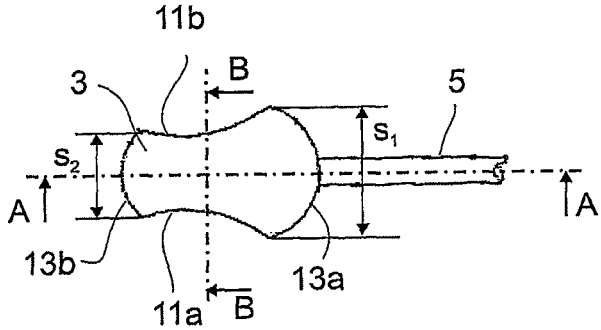
FIG. 5*a* is a top view of an eyelash spoon in the area of the shell.

When producing metallic shells 3, generally a planar sheet metal is first punched along the edge of the shell and then rolled to yield a form bent like a calotte. The radii specifying the shape of the edge of the shell and listed in the following relate to the planar, still unrolled material. Alternatively, this mass can also relate to the shape of the curved shell 3 as discernible in the top view according to FIG. 5*a*. FIGS. 5*b* and 5*c* show cross-sections of the eyelash spoon of FIG. 5*a* along the lines A-A and/or B-B. The curvature radius of the longitudinal cross-section of the shell 3 shown in FIG. 5*b* amounts to 65 mm, for example, the one of the cross-section shown in FIG. 5*c* approximately 70 mm. The length L of the shell 3 can range e.g., from approximately 40 mm to approximately 50 mm and preferably is approximately 45 mm.

Figure 2:
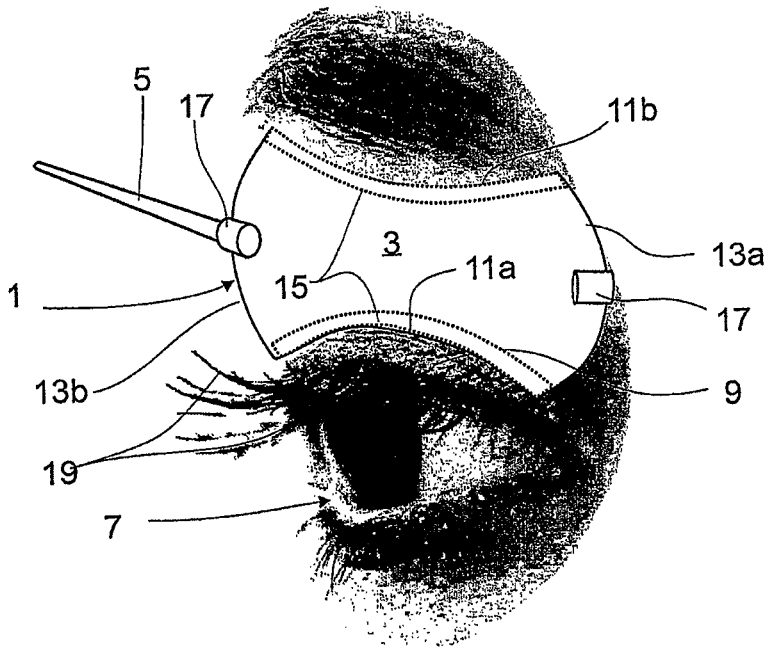
FIG. 2 is a view showing the application of an eyelash spoon in another embodiment.
Figure 3:
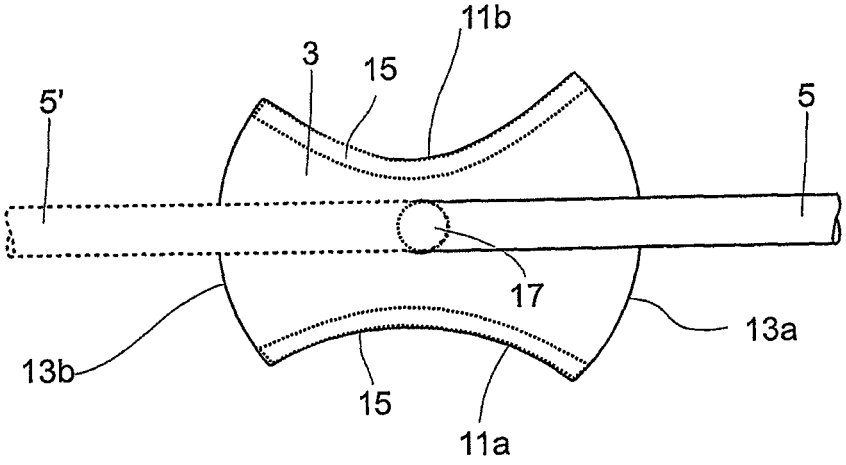
FIG. 3 is a view of a shell with various recesses and with a pivotally coupled handle.

The shell 3 and thus the recesses 11*a*, 11*b* are preferably embodied mirror-symmetrically such that the eyelash spoon 1 can be used equally for the left as well as the right eye 7. In a preferred embodiment of the eyelash spoon according to FIG. 1 the width $s_2$ of the shell 3 is smaller at the ends of the recesses 11*a*, 11*b* further distanced from the handle 5 than the width $s_1$ of the ends positioned closer to the handle 5. The width $s_2$ can show e.g., a value ranging from approximately 10 mm to approximately 25 mm and preferably is approximately 20 mm. The width $s_1$ can show e.g., a value ranging from approximately 20 mm to approximately 35 mm and preferably is approximately 30 mm. For the circular recesses 11*a*, 11*b* the radii of their curvature ranges preferably from approximately 15 mm to approximately 30 mm and preferably is approximately 21 mm. The above-listed values allow an optimum adjustment to most eyelids and an effective and precise application of mascara. Alternatively the recesses 11*a* and 11*b* positioned opposite each other can also show different radii of curvatures, so that an adjustment to different eye contours is possible. In this case preferably a coupling site 17 for the handle 5 is provided at both lateral edges 13*a*, 13*b* (FIG. 2) or alternatively a handle 5 (FIG. 3) that can be snapped in two end positions, with the second end position of the handle 5' being shown in broken lines, and is pivotal around a central coupling site 17 embodied at the convexly curved exterior side of the shell 3. In these final positions the handle 5 projects from the convexly curved lateral edges 13*a*, 13*b*. Preferably the curvature radii of the lateral edges 13*a*, 13*b* are approximately half the size as the corresponding widths $s_1$ and/or $s_2$ of the shell 3 at the respective side of the shell. Of course, values deviating therefrom are also possible.

Figure 4:
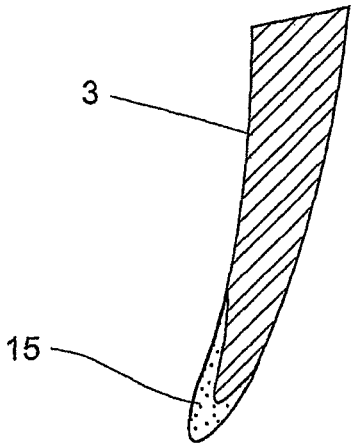
FIG. 4 is a detailed view of a cross-section through a shell.

Similar to a spoon for food, the shell 3 can be embodied with a constant material thickness. Alternatively the shell 3 can also be embodied as a "real" three-dimensional formation with different material thicknesses and e.g., show a cross-sectional shape similar to that of a contact lens. FIG. 4 shows a detail of such a shell 3 with an injection molded adhering element 15.

In order to apply mascara to eyelashes 19 the eyelash spoon 1 is held with one hand at the handle 5 and made to contact the upper eyelid 9 with the adhering element 15 closely spaced behind the lash-line. The eyelid is slightly pulled up with the eyelash spoon. The incline of the convexly curved exterior of the shell 3 is adjusted such that the eyelashes 19 can easily be brushed from the bottom upwards with a curve using the eyelash brush. The eyelashes 19 can here contact the shell 9, are brushed through, and yield the desired shape and thickness without any additional mechanical or thermal means.

Of course, the eyelash spoon 1 can also be used for applying mascara to the eyelashes 19 of the lower eyelids 9, in which the eyelash spoon 1 is made to contact the lower eyelid 9 in the area of the lash-line and the lower eyelid 9 pulled slightly downwards. Due to the recesses 11*a*, 11*b* positioned opposite each other the change from the upper to the lower eyelid 9 is possible in a simple manner and without changing the handle.

The invention claimed is:

1. An eyelash spoon (1) for a simple and effective application of mascara on eyelashes (19), comprising a calotte-like shell (3) with two recesses (11*a*, 11*b*) adjusted to a shape of an eye (9) that are mirror-symmetric and positioned diametrically opposite in reference to one another, and a handle (5) connected to the shell (3) that projects from one of two convexly rounded lateral edges (13*a*, 13*b*) thereof located adjacent to the recesses (11*a*, 11*b*) so that either of the two recesses is adapted to be used for the application of mascara, wherein the two symmetrically opposite recesses (11*a*, 11*b*) are concavely rounded and located adjacent to the lateral edges (13*a*, 13*b*) positioned opposite each other, and the lateral edges (13*a*, 13*b*) have different widths, and a larger width one of the convexly rounded lateral edges (13*a*) is closer to the handle (5).

2. An eyelash spoon (1) according to claim 1, wherein a width s2 of the shell (3) is smaller at one side of the recesses (11*a*, 11*b*) than a width s1 at an opposite side of the recesses (11*a*, 11*b*).

3. An eyelash spoon (1) according to claim 1, wherein adhering elements (15) are located in an area of the recesses (11*a*, 11*b*).

4. An eyelash spoon (1) according to claim 3, wherein the adhering elements (15) comprise roughened sections at an interior side of the shell (3).

5. An eyelash spoon (1) according to claim 1, wherein the handle (5) is connected to the shell (3) in one piece.

6. An eyelash spoon (1) according to claim 1, wherein the handle (5) can be connected in a detachable manner to at least one coupling site (17) located on the shell (3).

7. An eyelash spoon (1) according to claim 6, wherein the coupling site (17) is located centrally at a convexly curved exterior side of the shell (3).

8. An eyelash spoon (1) according to claim 7, wherein the handle (5) coupled to the coupling site (17) is pivotal around said coupling site (17) and can be snapped in place at least in one position.

9. An eyelash spoon according to claim 1, wherein a convexly curved exterior side of the shell (3) can be used as a contact when applying mascara to eyelashes (19).

10. A method for applying mascara to the eyelashes (19) of an eyelid (9) using an eyelash spoon (1) comprising: contacting an eyelid (9) in an area of the lash-line with either of two recesses (11*a*, 11*b*) provided on an eyelash spoon which are mirror-symmetric and positioned diametrically opposite one another on a calotte-shaped shell using a handle (5) connected to the shell (3) that projects from one of two lateral edges (13*a*, 13*b*) thereof located adjacent to the recesses (11*a*, 11*b*), pulling up or holding up the eyelid (9) with the eyelash spoon (1) and applying mascara to the eyelashes (19) with an eyelash brush beginning at the lash-line towards the tip of the eyelashes (19), and using an exterior side of the shell (3) as a contact surface for the eyelash brush.

11. An eyelash spoon (1) for a simple and effective application of mascara on eyelashes (19), comprising a calotte-like shell (3) with two recesses (11*a*, 11*b*) adjusted to a shape of an eye (9) that are mirror-symmetric and positioned diametrically opposite in reference to one another, and a handle (5) connected to the shell (3) that projects from one of two lateral edges (13*a*, 13*b*) thereof located adjacent to the recesses (11*a*, 11*b*) so that either of the two recesses is adapted to be used for the application of mascara, wherein a width $s_2$ of the shell (3) is smaller at one side of the recesses (11*a*, 11*b*) than a width $s_1$ at an opposite side of the recesses (11*a*, 11*b*), and the width $s_2$ is smaller at one end of the recesses further from the handle (5) than the width $s_1$ of ends closer to the handle (5).

* * * * *